United States Patent [19]

Eder

[11] Patent Number: 4,819,358

[45] Date of Patent: Apr. 11, 1989

[54] DEVICE FOR ADJUSTING THE TRIGGER WEIGHT OF A REVOLVER

[76] Inventor: Josef Eder,
Anton-Burgmeier-Strasse 3a, D-8060 Dachau, Fed. Rep. of Germany

[21] Appl. No.: 115,873

[22] Filed: Nov. 2, 1987

[30] Foreign Application Priority Data

Nov. 21, 1986 [DE] Fed. Rep. of Germany ..... 3639746

[51] Int. Cl.[4] ..... F41C 19/00; F41C 1/00

[52] U.S. Cl. ..... 42/65; 42/59

[58] Field of Search ..... 42/59, 65

[56] References Cited

U.S. PATENT DOCUMENTS 3,245,167 4/1966 Freed ..... 42/65
3,965,603 6/1976 Maillard ..... 42/65
4,109,402 8/1978 Guardamino ..... 42/65
4,384,422 5/1983 Röh ..... 42/65
4,391,057 7/1983 Bornancini ..... 42/65

*Primary Examiner*—Deborah L. Kyle
*Assistant Examiner*—Michael J. Carone
*Attorney, Agent, or Firm*—Paul L. Sjoquist

[57] ABSTRACT

A device for adjusting the trigger weight of a revolver having a return spring and thrust rod acting on the trigger. The thrust rod has one end which is articulately connected to the trigger and another end which capable of being adjustably positioned such that the angular position of the thrust rod with respect to the trigger is variable.

9 Claims, 3 Drawing Sheets

DEVICE FOR ADJUSTING THE TRIGGER WEIGHT OF A REVOLVER

Figure 1:
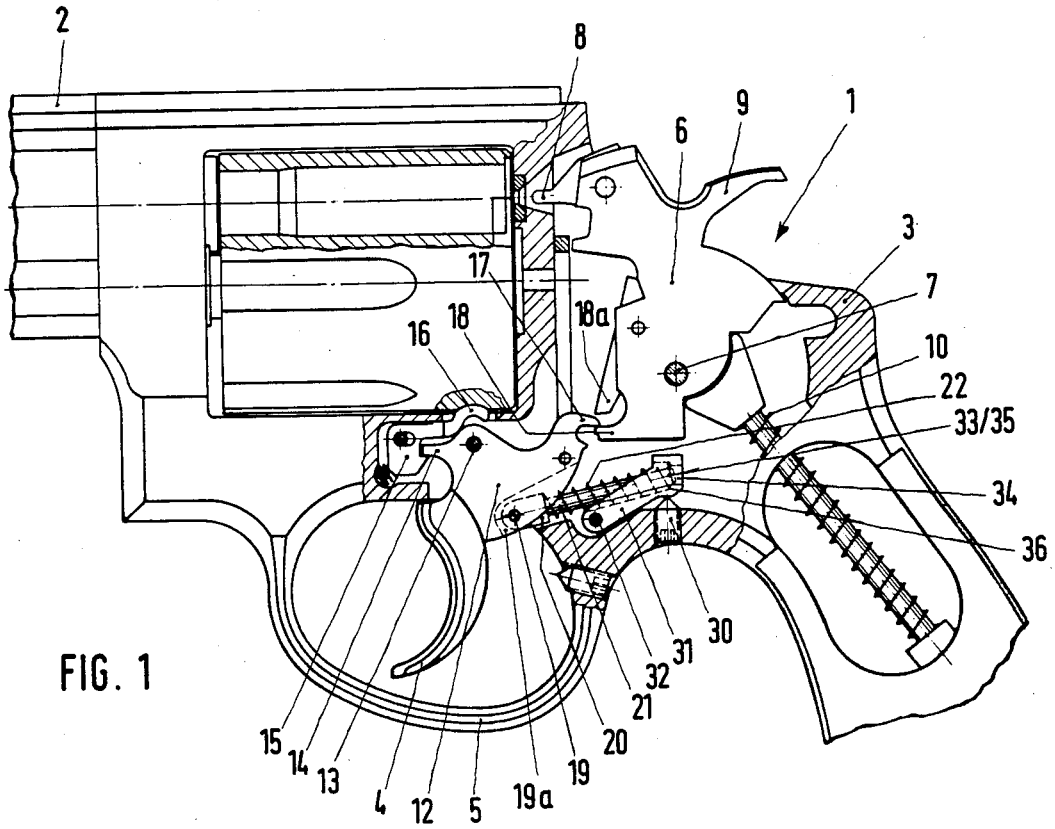

The invention relates to a device for adjusting the trigger weight of a revolver comprising in each case at least one return spring acting on the hammer and on the trigger.

Revolvers are divided fundamentally into two categories, that is single-action and double-action revolvers.

In single-action revolvers the cylinder advance is effected via the hammer and takes place when the hammer is cocked.

In double-action revolvers the cylinder advance and cocking of the hammer can be effected by pulling the trigger up to the firing point or by cocking the hammer by hand as in single-action revolvers.

In a known device of this type the trigger is subjected to the action of a leaf spring which is rotatably mounted by a pin in the grip; said spring acts via a roller indirectly on the trigger. The bias of said spring is adjustable by a screw inset in the grip. On the one hand, this spring presses the trigger back to its inoperative position and on the other hand influences considerably the trigger weight in single-action operation. The grub screw acting on the free end in the grip is adjustable from the outside but does not permit an exactly predictable biasing because the adjustment of a spring in general cannot enable exactly predetermined weight changes of the trigger without negatively influencing the spring force in the initial pulling region.

However, it is necessary in particular in weapons used for sport shooting to make an exactly predictable weight adjustment of the trigger because for example in sport shooting for men the weight exerted on the trigger should be about 300 g greater than in corresponding sport shooting for women and junior competitors.

The invention is based on the problem of providing a device of the type mentioned at the beginning with which an adjustment of the trigger weight is possible to an exactly predeterminable extent without the initial pull weight being so greatly changed that the function is influenced.

This problem is solved in that according to the invention in that at a distance from the trigger pivot joint towards the trigger guard a thrust rod or the like is articulately connected to the trigger and the angular position of said rod with respect to the trigger is adjustable.

This makes it possible independently of the spring force acting on the trigger to exactly predetermine and set the weight load of the trigger, a link chain being formed between the adjusting screw and trigger and the effect thereof not decreasing even after extensive use of the weapon.

According to a preferred embodiment of the invention in the grip an adjusting screw, grub screw or the like is provided which engages the thrust rod or the like at a distance from the articulation. Generally, this adjusting or set screw is provided between the trigger guard and the grip.

According to a preferred embodiment of the invention the thrust rod or the like at a distance from the articulation has a variable pivot point. This pivot point or this pivot position varies according to whether the trigger is in the inoperative position or in the cocked position.

According to an embodiment of the invention the pivot point lies in an opening of a holder, stirrup member or the like which is formed as extension of the adjusting screw.

According to a modified embodiment of the invention the pivot point lies in an opening of a link or the like which is attached to the grip, the adjusting screw being directed towards the pivot point.

Whereas it is readily possible to use all types of springs for the return movment of the trigger, it has been found advantageous for the thrust rod to carry a pressure spring. The articulation of the thrust rod consists preferably of an eye engaging in a cutout in the trigger and a pivot pin. The opening can be enlarged for displaceable accommodation of the rod on both sides of the pivot point. The thrust rod is preferably widened at its eye end as abutment for the helical spring. Conveniently, in the holder, stirrup member, link or the like an abutment for the helical spring is provided in the region of the pivot point.

Figure 2:
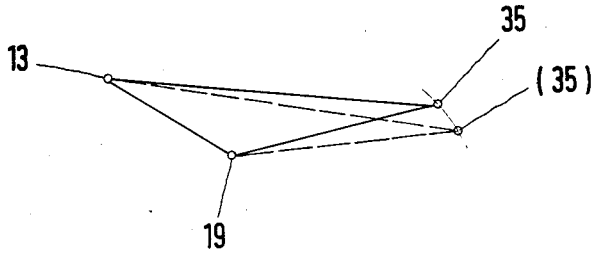
Figure 3:
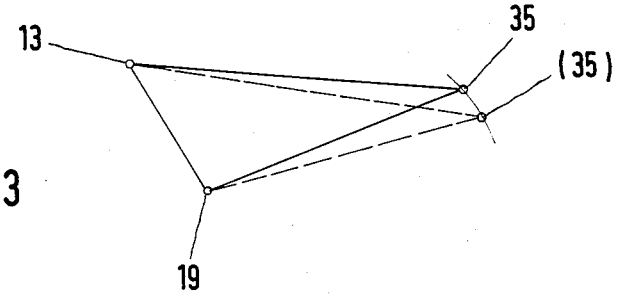
Figure 4:
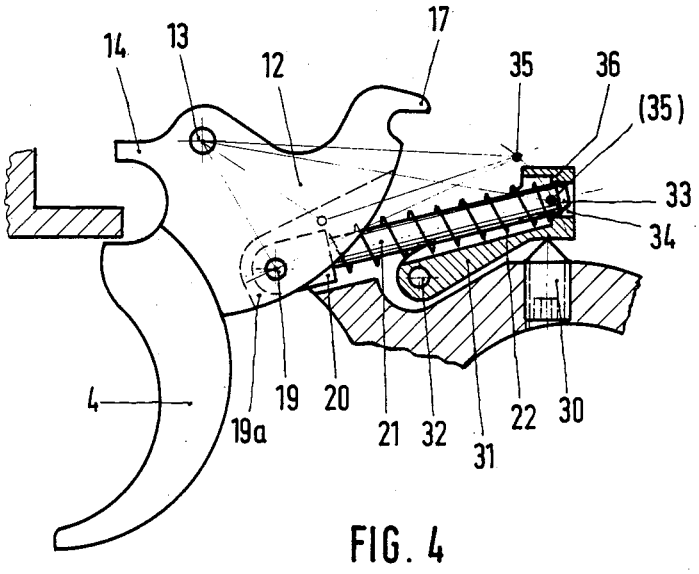
Figure 5:
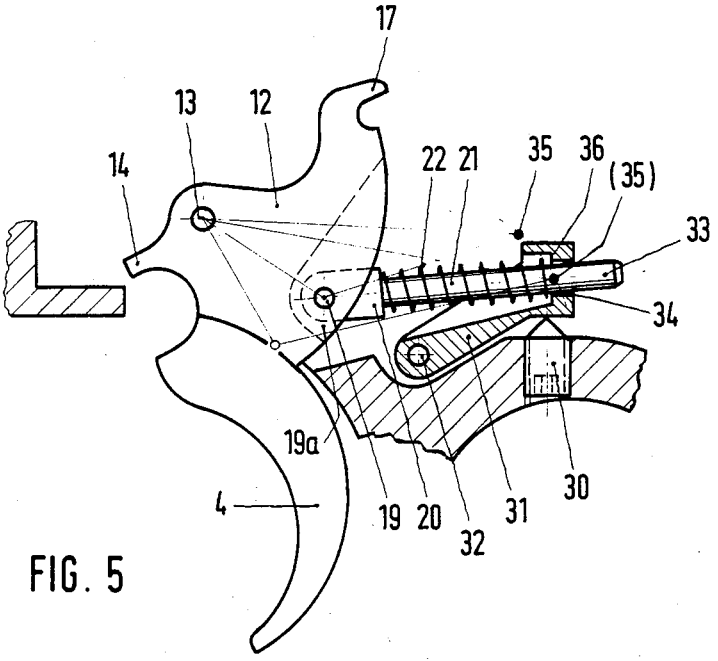
Figure 6:
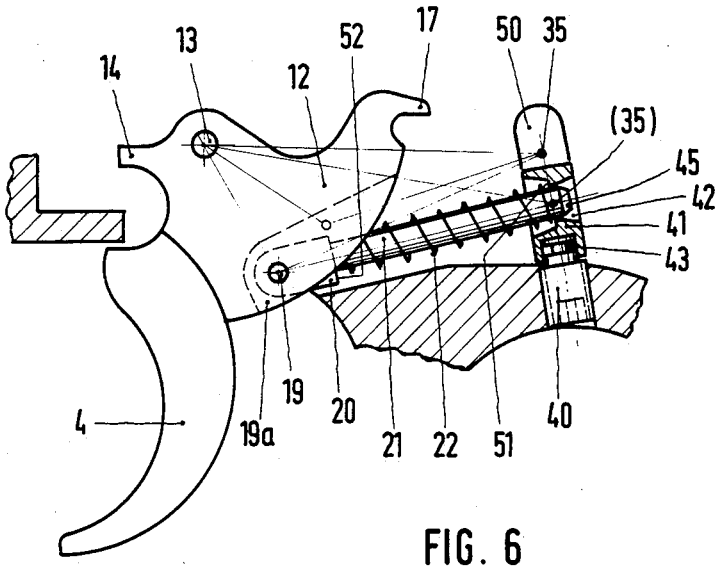
Figure 7:
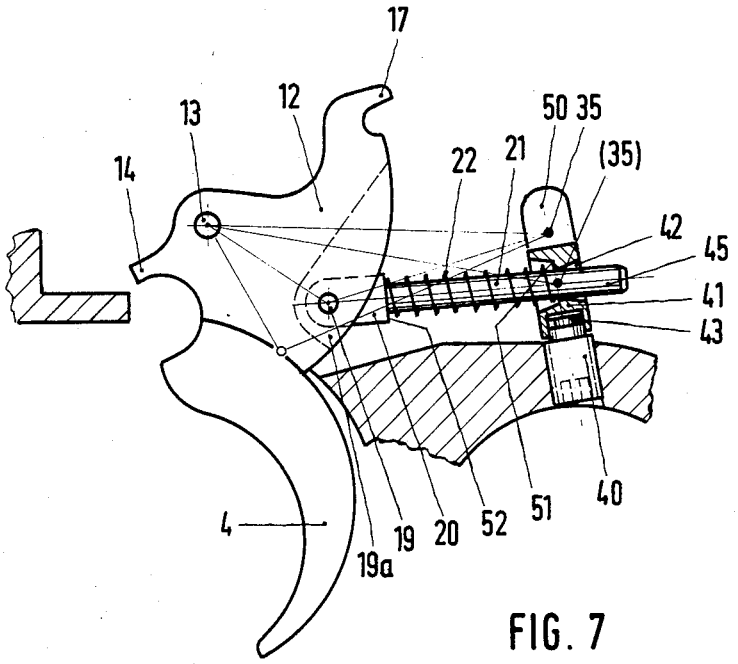

Examples of embodiment of the subject of the invention will be described hereinafter in detail with the aid of the drawings, wherein:

FIG. 1 is a partial section through a revolver,

FIGS. 2 and 3 show basic sketches of the angular adjustment of the thrust rod, FIGS. 4 and 5 show an embodiment of the invention as detail of FIG. 1 to a larger scale in two positions of the trigger and FIGS. 6 and 7 show a modified embodiment of the invention in a similar view to FIGS. 4 and 5, likewise to a larger scale and in each case in two positions of the trigger.

A revolver 1 comprises a barrel 2, a grip 3, a trigger 4 with trigger guard 5 and a hammer 6.

The hammer 6 is pivotal about a pivot pin 7 and comprises a firing pin 8. The hammer 6 can either be cocked by hand via the hammer nose 9 against the action of a pressure spring 10 or, as explained in detail below, from the trigger. Connected to the trigger 4 is a plate-shaped member 12; the trigger 4 is pivotal about a pivot pin 13 and comprises a nose 14 which engages in a resiliently mounted catch 15, the projection 16 of which locks the cylinder before each shot.

The plate-shaped member 12 further comprises a projection 17 which on actuation of the cock trigger engages a lever **18*a* of the hammer 6** and, as explained in detail below, releases the hammer after the cylinder advance for firing.

When using single-action (sport shooting) the cylinder advance is actuated by cocking the hammer 6. When this is done the claw 17 of the member 12 comes beneath the projection 18 of the hammer 6 and is ready for firing.

At the side of the plate-shaped member 12 of the trigger 4 remote from the barrel a cavity or recess **19*a* is provided into which a thickened end 20 of a thrust rod 21 engages. The thrust rod is thus pivotal about the articulation 19 and carries a helical pressure spring 22 which is supported at the thickened end 20**.

In the region between the trigger guard 5 and the grip 3 a grub screw 30 is provided which acts on the lower side of a link 31 which in turn can be pivoted about a pivot pin 32 attached to the grip. The free end 33 of the rod 21 is pivotal about the pivot point or the articulation 35 and on the other hand however also mounted displaceably in an opening 34 in the link 31. A shoulder face 36 in the region of the opening 34 is provided as abutment for the helical pressure spring 22.

The illustration in FIG. 1 and that in FIG. 4 are identical as regards the position of the trigger 4, i.e. this is the so-called inoperative position before any cylinder advance.

FIG. 5 shows the cocked position of the trigger after the cylinder advance; as already explained above the nose 17 has released the corresponding projection 18. The blocking of the cylinder by the projection 16 meanwhile effected is not illustrated. The cylinder is now ready for firing.

The weight load of the trigger 4, which generally varies in sport weapons between about 1360 g and 1000 g, is adjustable within this range, this being done by the grub screw 30.

As apparent from FIG. 2 the inoperative position prior to cylinder transport is defined by the triangle 13, 19, 35, with the grub screw 30 screwed in as far as possible. On screwing back the grub screw 30 the position 13, 19 (35) is reached, i.e. another angular position with respect to the trigger.

FIG. 4 shows similar triangles which however correspond to a cocked position after the cylinder advance.

As apparent from FIGS. 4 and 5 the longitudinal axis of the grub screw 30 corresponds approximately to the joint point or pivot point 35.

In the embodiment illustrated in FIGS. 6 and 7 the thrust rod 21 is again pivotal about the articulation 19 and the trigger 4 pivotal about the pivot pin 13. The grub screw 40 in this embodiment is inserted inclined into the portion of the housing between the grip 3 and the guard 5 of the trigger and via a plug connection 43 holds a stirrup member 41.

The thrust rod 21 may be circular or polygonal in crosssection and with its free end 45 passes through an opening 42 in the stirrup member 41. The joint point or pivot point 35 lies in the extension of the longitudinal axis of the grub screw 40 inserted in inclined manner, irrespective of whether the position is the inoperative position as illustrated in FIG. 6 prior to cylinder advance or, as illustrated in FIG. 7, the cocked position after cylinder advance.

The thrust rod 21 is mounted in a central guide 50 in the stirrup member 41. The opening 42 widens towards the end remote from the trigger in the form of a funnel or pyramid.

The opening 42 is also widened in the form of a funnel or pyramid towards the trigger and comprises a shoulder face 51 which serves as abutment for the pressure spring 22. The end of the thrust rod 21 pivotal about the pivot pin 19 comprises in this region an enlarged cross-section so that a shoulder face 52 results which is formed as second abutment for the helical spring 22.

Both FIGS. 5 and 7 show the trigger 4 in the position ready for firing, i.e, for example with a weight load of about 1360 g or 1000 g. A higher weight load than 1360 or 1000 g moves the trigger beyond the pressure point and initiates the firing by the firing pin 8 striking the firing cap of the corresponding cartridge case.

I claim:

1. A device for adjusting the trigger weight of a revolver wherein a trigger is pivotally mounted about a trigger pivot joint in the body of the revolver and is movable within a trigger guard to actuate a hammer, comprising a thrust rod articulately connected to the trigger at one of its ends and having the other of its ends slidably coupled through a guide, which guide is movable relative to said body, a spring engageable between said trigger and said guide, and means for moving said guide relative to said gun body to modify the angular position of the thrust rod with respect to the trigger.

2. The device of claim 1, wherein said means for moving said guide further comprises an adjusting screw threadable in said body.

3. Device according to claim 1, characterized in that the thrust rod at a distance from the articulation has a variable pivot point.

4. The device of claim 3, wherein said means for moving said guide further comprises an adjusting screw threadable in said body.

5. Device according to claim 4, characterized in that the variable pivot point lies in an opening of said guide which is formed as extension of said adjusting screw.

6. Device according to claim 4, characterized in that the variable pivot point is formed in an opening of said guide, said guide being attached to the body and that the adjusting screw is directed towards the variable pivot point.

7. Device according to claim 6, characterized in that the articulation connection o the thrust rod consists of an eye engaging in a recess in the trigger, and said connection including a pivot pin.

8. Device according to claim 6, characterized in that for displaceable accommodation of the thrust rod the opening is enlarged on both sides of the variable pivot point to a size larger than the cross-section of said thrust rod.

9. Device according to claim 7, characterized in that the thrust rod is widened at its eye end as abutment for the spring.

* * * * *